US006791307B2

(12) United States Patent
Harrison

(10) Patent No.: US 6,791,307 B2
(45) Date of Patent: Sep. 14, 2004

(54) NON-LINEAR CURRENT GENERATOR FOR HIGH-ORDER TEMPERATURE-COMPENSATED REFERENCES

(75) Inventor: William Todd Harrison, Apex, NC (US)

(73) Assignee: Intersil Americas Inc., Milpitas, CA (US)

( * ) Notice: Subject to any disclaimer, the term of this patent is extended or adjusted under 35 U.S.C. 154(b) by 59 days.

(21) Appl. No.: 10/265,171

(22) Filed: Oct. 4, 2002

(65) Prior Publication Data

US 2004/0066180 A1 Apr. 8, 2004

(51) Int. Cl.[7] ..... G05F 3/04
(52) U.S. Cl. ..... 323/312
(58) Field of Search ..... 323/312, 313, 323/315, 316; 327/539, 512, 513

(56) References Cited

U.S. PATENT DOCUMENTS 4,443,753 A * 4/1984 McGlinchey ..... 323/313
4,939,442 A * 7/1990 Carvajal et al. ..... 323/281
5,686,821 A * 11/1997 Brokaw ..... 323/273
5,952,873 A 9/1999 Rincon-Mora ..... 327/539
6,157,245 A 12/2000 Rincon-Mora ..... 327/539
6,329,868 B1 * 12/2001 Furman ..... 327/513
6,642,699 B1 * 11/2003 Gregoire, Jr. ..... 323/314

* cited by examiner

*Primary Examiner*—Adolf Berhane
(74) *Attorney, Agent, or Firm*—Allen, Dyer, Doppelt, Milbrath & Gilchrist, P.A.

(57) ABSTRACT

A current generator generates a non-linear output current whose temperature coefficient exhibits a prescribed non-linear-to-quasi-linear curvature when a control voltage range is restricted. This particular current characteristic enables a voltage reference employing the current generator for high-order curvature correction to produce an output voltage whose variation is extremely flat over its industry standard operational temperature range.

15 Claims, 11 Drawing Sheets

NON-LINEAR CURRENT GENERATOR FOR HIGH-ORDER TEMPERATURE-COMPENSATED REFERENCES

FIELD OF THE INVENTION

The present invention relates in general to temperature-compensated electronic reference circuits and components therefor, and is particularly directed to a new and improved voltage-controlled current generator, which is operative to generate an output current that exhibits a prescribed non-linear to linear characteristic with temperature when its control voltage range is restricted. Injecting this output current into a voltage reference circuit, such as a 'Brokaw' bandgap voltage reference, provides improved high-order curvature correction, yielding an output voltage whose variation over a temperature range (e.g., −20° C. to +125° C.) is extremely flat (e.g., within several hundreds of microvolts).

BACKGROUND OF THE INVENTION

FIG. 1 is a reduced complexity diagram of a conventional first-order, current-based bandgap voltage reference, which generates an output voltage that is substantially independent of temperature, by summing a plurality of components whose temperature coefficients vary in a mutually complementary manner. For this purpose, a current I1 proportional to absolute temperature (PTAT) is supplied to a series circuit of a diode D1 and a resistor R1 (referenced to ground (GND)). The voltage V1 across diode D1 has an inverse or complementary to absolute temperature (CTAT) characteristic. As a result, if the (PTAT) current I1 is inversely proportional to the value of a resistor having the same temperature coefficient as that of the resistor R1, the temperature behaviors of the respective voltage drops across diode D1 and resistor R1 will be mutually complementary, making the output voltage V2 at a terminal OUT substantially (to a first order) independent of temperature.

A non-limiting example of what is commonly referred to as a 'Brokaw cell' current mirror implementation of the temperature-compensated bandgap voltage reference of FIG. 1 is schematically shown in FIG. 2. A current mirror circuit is formed of a first pair of MOSFETs including a MOSFET M1 and a diode-connected MOSFET M2 in a current mirror first leg containing a diode-connected MOSFET M5, and a second pair of MOSFETs comprised of diode-connected MOSFET M3 and MOSFET M4 in a second current mirror leg containing a MOSFET M6. MOSFETs M1 and M4 have their source-drain paths coupled in series with those MOSFETs M5 and M6 between voltage rail VDD and GND.

Diode-connected MOSFET M2 has its gate connected in common with the gate of MOSFET M1, while MOSFET M4 has its gate connected in common with the gate of diode-connected MOSFET M3. MOSFET M2 has its source-drain path coupled in series with the collector-emitter path of a bipolar NPN transistor Q1 and resistors R2 and R3 to GND. In a complementary manner, MOSFET M3 has its source-drain path coupled in series with the collector-emitter path of a bipolar NPN transistor Q2 and resistor R3 to GND. The bases of transistors Q1 and Q2 are coupled to a voltage output terminal OUT. A MOSFET M7 has its source-drain path coupled between voltage rail VDD and output node OUT, to which an output resistor RL referenced to GND is coupled. MOSFET M7 has its gate coupled to the drain of MOSFET M4.

In the current mirror-based implementation of FIG. 2, the current flowing through MOSFETs M2 and M3 corresponds to the base-emitter difference voltage ΔVBE divided by the value of resistor R2, and is PTAT. Thus, the current I1 supplied through resistor R3 produces a PTAT voltage thereacross which is combined with the CTAT VBE voltage V1 across transistor Q2 to derive an output voltage reference V2 having a first-order compensated temperature coefficient. As shown in FIG. 3, the voltage V2 of the bandgap reference circuit of FIG. 2 varies with temperature in a substantially parabolic manner, and has a total variation on the order of 6.7 mV. A first order voltage references of the type shown in FIG. 2 is capable of producing a reference voltage whose temperature coefficient typically falls between 20 to 100 ppm/° c.

FIG. 4 illustrates a high-order compensating modification of the current-based voltage reference of FIG. 1, which employs an additional current component I2 having a non-linear temperature coefficient. This additional non-linear current is intended to compensate for high-order, temperature dependent terms from the contribution of voltage V1. In the voltage reference of FIG. 4, the resistor R1 of reference circuit of FIG. 1 is shown as series-connected resistors R4 and R5, with an additional, high-order compensation non-linear current I2 being supplied to the common connection of these two resistors.

One example of this type of bandgap voltage reference circuit that injects an additional non-linear current is disclosed in the U.S. Pat. No. 6,157,245 to Rincòn-Mora. (For a non-limiting example of additional prior art documentation showing another type of current-based bandgap reference circuit, attention may be directed to the U.S. Pat. No. 5,952,873 to Rincòn-Mora.) The above-referenced '245 patent describes that second-order compensation may be achieved by injecting an additional non-linear current whose temperature coefficient is proportional to the 'square' of PTAT (or $I^2$PTAT), so that its characteristic is parabolic.

While the squared temperature coefficient of the additional current tends to provide a second-order improvement at relatively low temperatures, where the variation in slope of the parabolic (squared) temperature coefficient characteristic is relatively gradual, the performance of an $I^2$PTAT current-based voltage reference undesirably degrades at higher temperatures, due to the increasingly steep slope of the injected current's parabolic characteristic at such temperatures.

SUMMARY OF THE INVENTION

In accordance with the present invention, shortcomings of conventional first- and second-order compensated voltage references, including those described above, are substantially reduced by injecting into a voltage reference circuit, such as a 'Brokaw' voltage reference, a high-order, compensation current derived from a voltage controlled, non-linear current generator. This non-linear current generator is configured to generate an output current whose temperature coefficient exhibits a prescribed non-linear-to-quasi-linear curvature when the input or control voltage range is restricted. As will be described, this particular current characteristic enables a voltage reference that incorporates such a non-linear current generator for high-order curvature correction to produce an output voltage whose variation over an operational temperature range (e.g., −20° C. to +125° C.) is extremely flat (e.g., within several hundreds of microvolts). The inclusion of the non-linear current generator described herein in a bandgap reference allows a simple, power and area efficient method to achieve a curvature corrected output voltage.

To this end, the non-linear current generator according to the invention comprises an input transistor, referenced to a first power supply rail and having its collector-emitter path coupled in series with a PN junction device, such as a diode-connected transistor, to series-connected resistors that are coupled to a second power supply rail. The control electrode or base of the input transistor is coupled to receive an input or 'reference' (control) voltage, whose value is restricted or maintained within an 'optimum' range, in accordance with the desired operational parameters of the diode-connected transistor. In particular, this control voltage is set to a value, such that, in the low temperature region of operational temperature range, the diode-connected bipolar transistor operates just below the non-linear transition or 'knee' of its non-linear transfer characteristic. An output transistor has its emitter coupled to the common connection of the series resistors and its base coupled in common with the base of the diode-connected transistor. The collector of the output transistor is coupled to a current mirror, which mirrors the non-linear collector current from the output transistor as the desired non-linear output current $I_{NL}$.

At cold temperatures and with an input voltage such that the voltage drop across the base-emitter of the input and output transistors causes the resistance of each branch to be large, the output current is very small. With an increase in temperature, the characteristics of the bipolar junction transistor cause the resistance of each collector-emitter path to decrease in an exponential fashion. As a consequence, the voltage across a summation resistor increases in the same exponential fashion and so does the output current. As temperature increases, the resistance of the collector-emitter paths of the transistors of the two branches becomes comparable to the resistance of the summation resistor, allowing some of the voltage drop from the input voltage to ground to be applied across the summation resistor.

The resistance of the series resistor is set such that it becomes larger than the decreasing collector-emitter resistance of the diode-connected transistor, so that its branch resistance stops its exponential decrease and becomes dependent on the resistance of the resistor in series with the summation resistor. The effect of the resistance of the diode-connected transistor and the series resistor branch being dominated by the series resistor, and thus the output transistor resistance becoming comparatively smaller, is such that the base-emitter voltage of the output transistor begins to decrease with temperature.

With the decrease in the base-emitter voltage of the output transistor, its collector-emitter path resistance begins to increase again, until the effects of increasing temperature become more dominant again and cause the resistance to decrease. At temperatures above this point, the voltage across the summation resistor increases in proportion to the temperature coefficient of 2VBEs, which is on the order of (−1)(2)(−2 mV/° C.)=±4 mV/° C., on a first-order basis.

The characteristics of the output current of the non-linear current generator improve the temperature performance of the bandgap voltage reference. With a first-order bandgap voltage reference curve shifted toward colder temperatures, the added positive temperature coefficient of the non-linear current generator initially causes the decreasing output voltage to increase. Then, as the slope of the output current vs. temperature of the non-linear current generator begins to decrease, the output voltage starts to decrease, until the contribution of the non-linear current causes the output voltage to increase again. When the resistor values are properly chosen, an optimized output voltage temperature characteristic can be realized.

Summing the voltages across the series resistors and the base-emitter junction of the bipolar transistor whose base and emitter are coupled between the voltage output terminal and the series resistors causes the curvature-corrected reference voltage circuit, to which the non-linear current $I_{NL}$ is injected, to produce a reference voltage whose variation with temperature is confined within a very narrow (several hundred microvolts) range, which corresponds to a relatively small temperature coefficient (on the order of 2 ppm/° C.).

In addition to being used as a source of high-order compensation current for a 'Brokaw' current mirror-based bandgap voltage reference, the non-linear current generator of the invention may be combined with other temperature-controlled current sources, to produce a high-order, temperature compensated output current reference $I_{REF}$, which exhibits an output current vs. temperature variation, that is extremely narrow (e.g., on the order of only tens of nanoamps over a range of from −20° C. to 125° C.)

DETAILED DESCRIPTION

Figure 1:
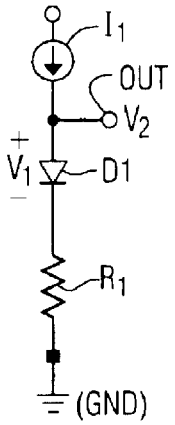
FIG. 1 PRIOR ART
FIG. 1 is a reduced complexity diagram of a conventional current-based bandgap voltage reference.
Figure 2:
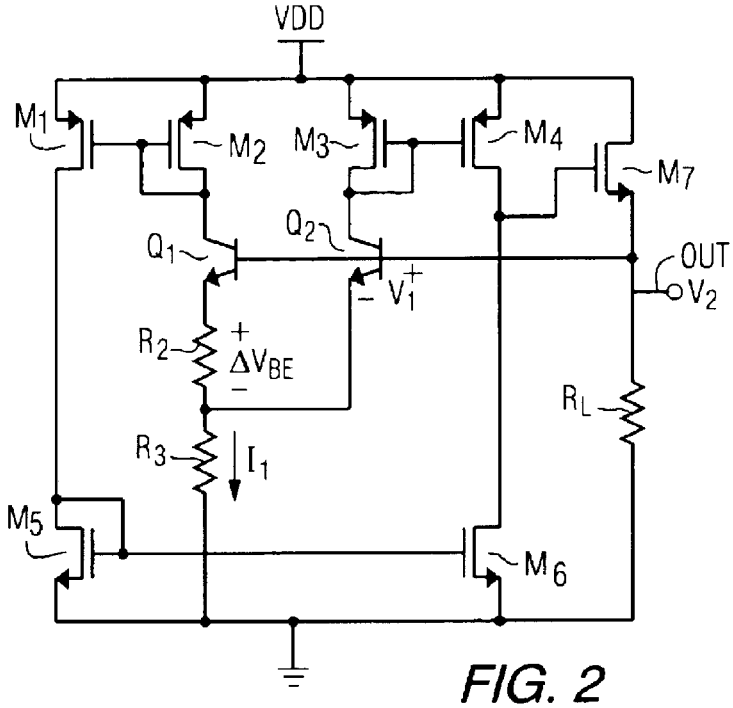
FIG. 2 PRIOR ART
FIG. 2 is a schematic diagram of a 'Brokaw' current mirror-based implementation of the bandgap voltage reference of FIG. 1.
Figure 5:
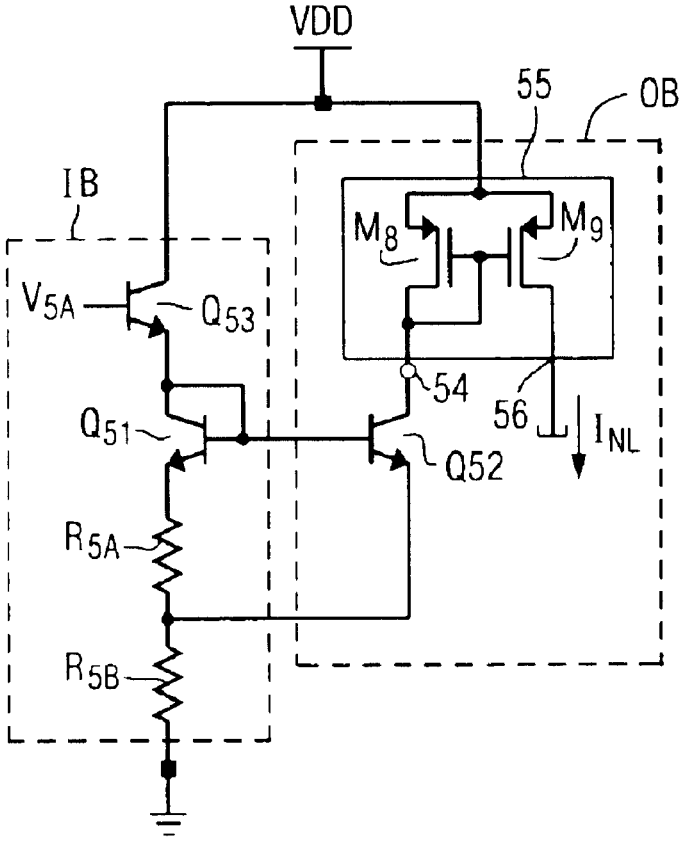
FIG. 5 is a circuit diagram of a voltage-controlled, non-linear current generator in accordance with the invention.

Attention is now directed to the circuit diagram of FIG. 5, which shows an embodiment of a voltage-controlled, non-linear current generator according to the present invention, that may be used to supply a high-order curvature correction current, and which is readily incorporatable into a 'Brokaw' type bandgap voltage reference shown in FIG. 2, described above. As pointed out above, and as illustrated in FIG. 5, the non-linear current generator of the present invention produces an output current $I_{NL}$ (which is mirrored off a collector current $I_{Q52C}$ of an output transistor Q52 within a current output branch OB), with a positive temperature coefficient that varies non-linearly with temperature, when a control or input reference voltage $V_{5A}$ applied to an input transistor Q53 in a current input branch IB is restricted or maintained within a prescribed range.

Figure 5A:
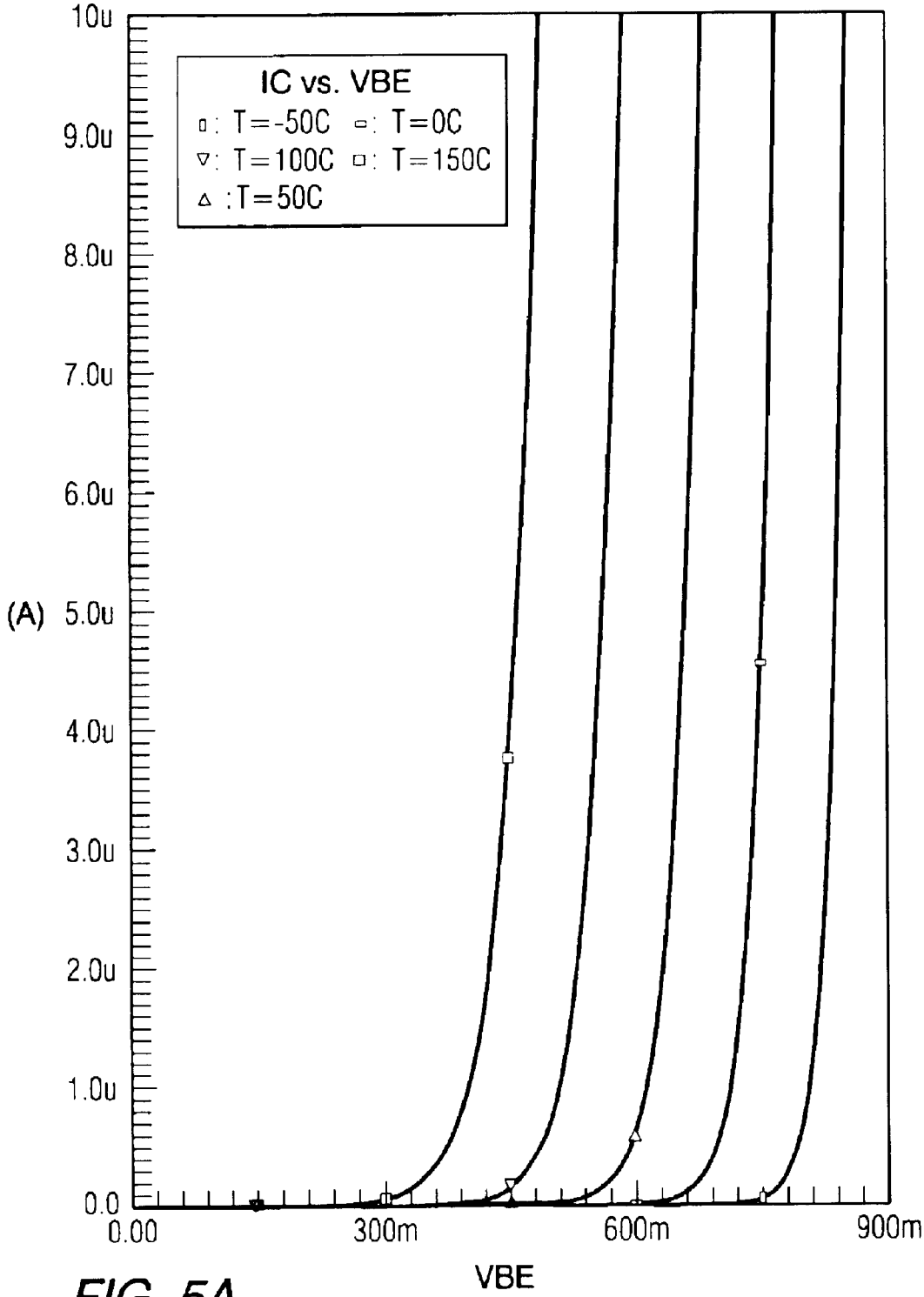
FIG. 5A shows a plurality of curves representative of the variation in collector current versus base-emitter voltage for different temperatures.

This prescribed control voltage range is such that, in the low temperature region of an operational temperature range, a PN junction device, shown as diode-connected (NPN) bipolar transistor Q51, installed within current input branch IB, operates just below the 'knee' of its non-linear I-V transfer characteristic. This serves to effectively 'squeeze' the voltage $V_{R5B}$ across a current summing resistor R5B, which controls the magnitude of the output current $I_{NL}$. As temperature increases, diode-connected transistor Q51 operates over the knee portion of its transfer function, so as to provide a non-linearity whose shape provides the desired second-order correction. FIG. 5A shows the variation in collector current vs. base-emitter voltage for a plurality of different temperatures.

More particularly, in the non-linear current generator of FIG. 5 diode-connected transistor Q51 has its collector-emitter current flow path connected in series with the collector-emitter current flow path of an input (NPN) transistor Q53 and series-connected resistors R5A and R5B, between a pair of power supply rails VDD and GND. The base of input transistor Q53 is coupled to receive an input or 'reference' (control) voltage V5A, whose value is restricted in accordance with the desired operational parameters of diode-connected transistor Q51, resistor R5A and transistor Q52, as described above. Output transistor Q52 has its emitter coupled to the common connection of resistors R5A and R5B, and its base coupled in common with the base of the diode-connected transistor Q51. The collector of output transistor Q52 is coupled to an input port 54 of a current mirror 55, comprised of MOSFETs M8 and M9, which mirrors the non-linear collector current from output transistor Q52 at port 54 as non-linear output current $I_{NL}$ at an output port 56.

The non-linear current generator of FIG. 5 operates as follows. The parameters of the circuit are such that transistors Q53 and Q52 are biased in the forward active mode, while transistor Q51, being diode-connected, is forced to the edge of saturation. In addition, as pointed out above, the input voltage V5A applied to the base of input transistor Q53 is such that it effectively restricts the voltage across R5B in the low temperature region of its operational temperature range.

As the temperature increases, the current through each current branch IB and OB, and therefore the voltage $V_{R5B}$ across summation resistor 5B, will increase in a non-linear (generally exponential) manner (over the 'knee' region of the diode transfer function of transistor Q51), since the base-emitter voltages Vbe's of the transistors remain substantially constant, until Vbe reaches the forward base-emitter turn-on voltage $Vbe_{ON}$. This means that the collector current $I_{Q52C}$ of output transistor Q52, and therefore the output current $I_{NL}$ at the output port 56 of the current mirror 55, will behave in the same manner.

When the temperature reaches the Vbe 'turn-on' temperature, the branch currents (and therefore the output current $I_{NL}$ of current mirror 55), as well as the voltage $V_{R5B}$ across current summing resistor R5B, will transition from increasing in a non-linear (exponential) manner to a more linear fashion due to the dominant first order negative temperature coefficient of Vbe.

Figure 5B:
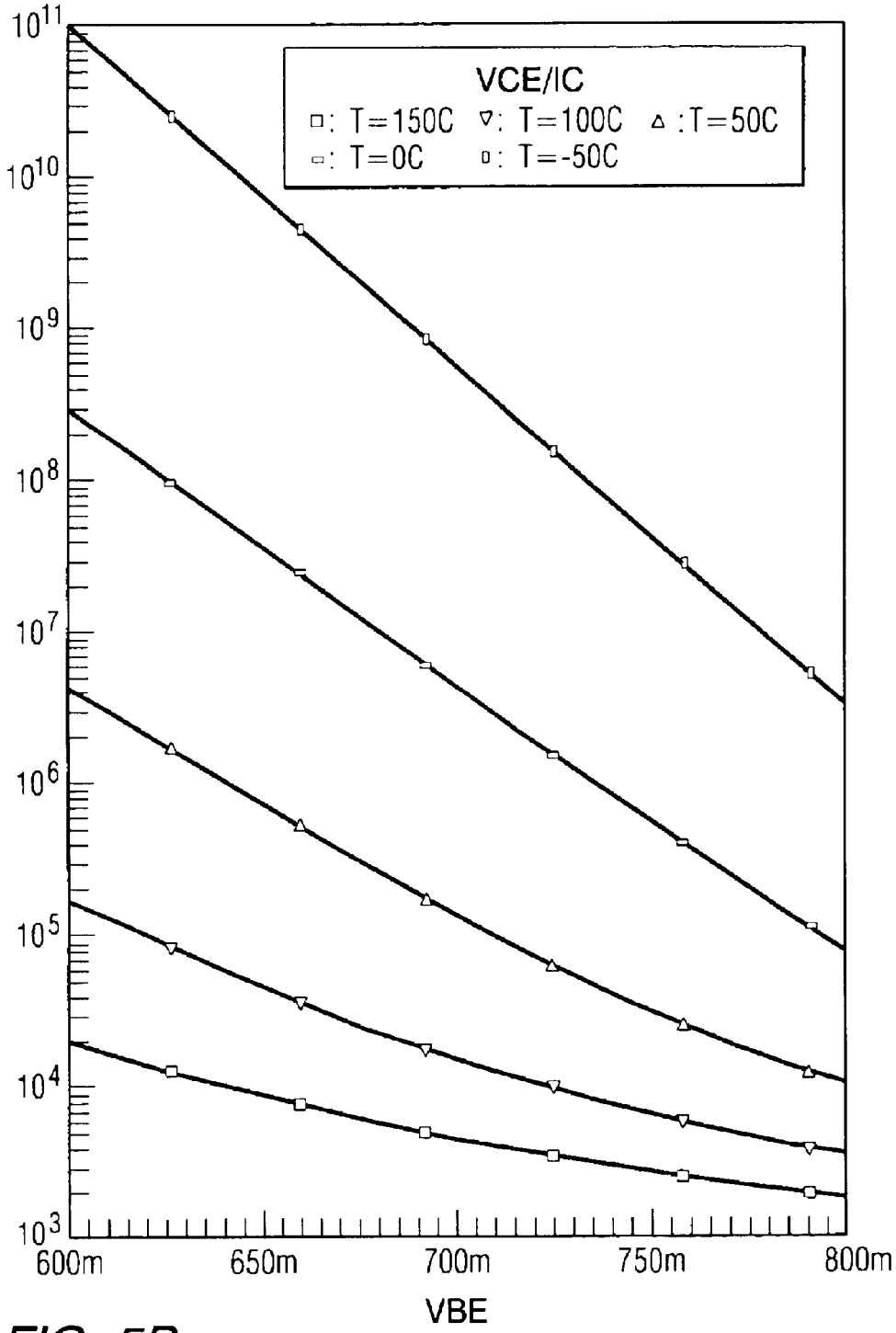
FIG. 5B shows a plurality of curves representative of the variation in collector-emitter path resistance versus base-emitter voltage for different temperatures.
Figure 5C:
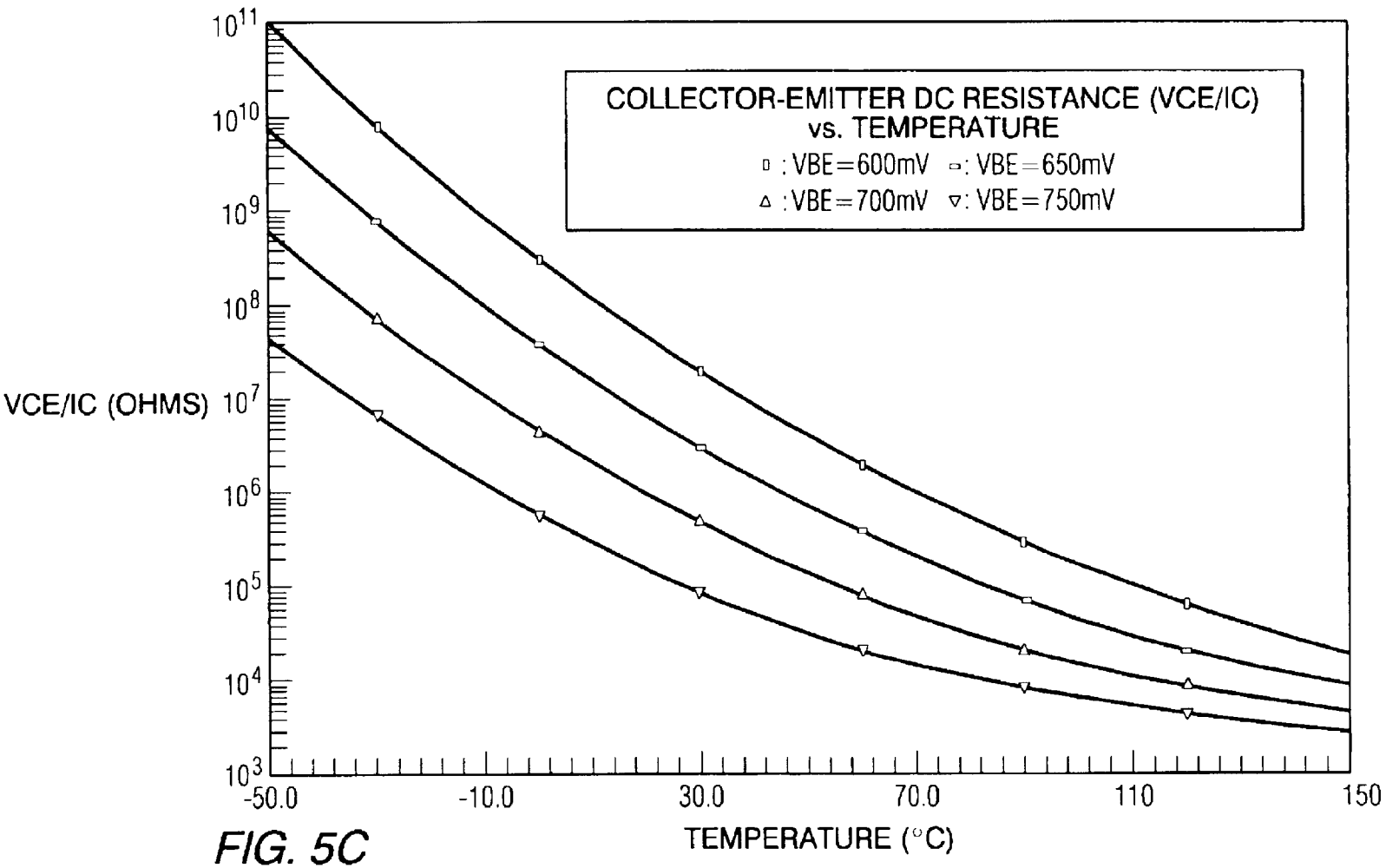
FIG. 5C shows a plurality of curves representative of the variation in collector-emitter path resistance versus temperature for different values of base-emitter voltage.

Namely, at cold temperatures and with an input voltage such that the voltage drop across the base-emitter of transistors Q53 and Q52 causes the resistance of each branch to be large (as shown in FIG. 5B), the output current is very small. As the temperature increases, the characteristics of the bipolar junction transistor causes the resistance of each collector-emitter path (RCE) to decrease in an exponential fashion (as shown in FIG. 5C). As a result, the voltage across resistor R5B increases in the same exponential fashion and so does the output current. With an increase in temperature, the resistance of the collector-emitter (RCE) paths of transistors Q51 and Q52 becomes comparable to the resistance of resistor R5B, allowing some of the voltage drop from voltage V5A to ground to be applied across resistor R5B.

Figure 5D:
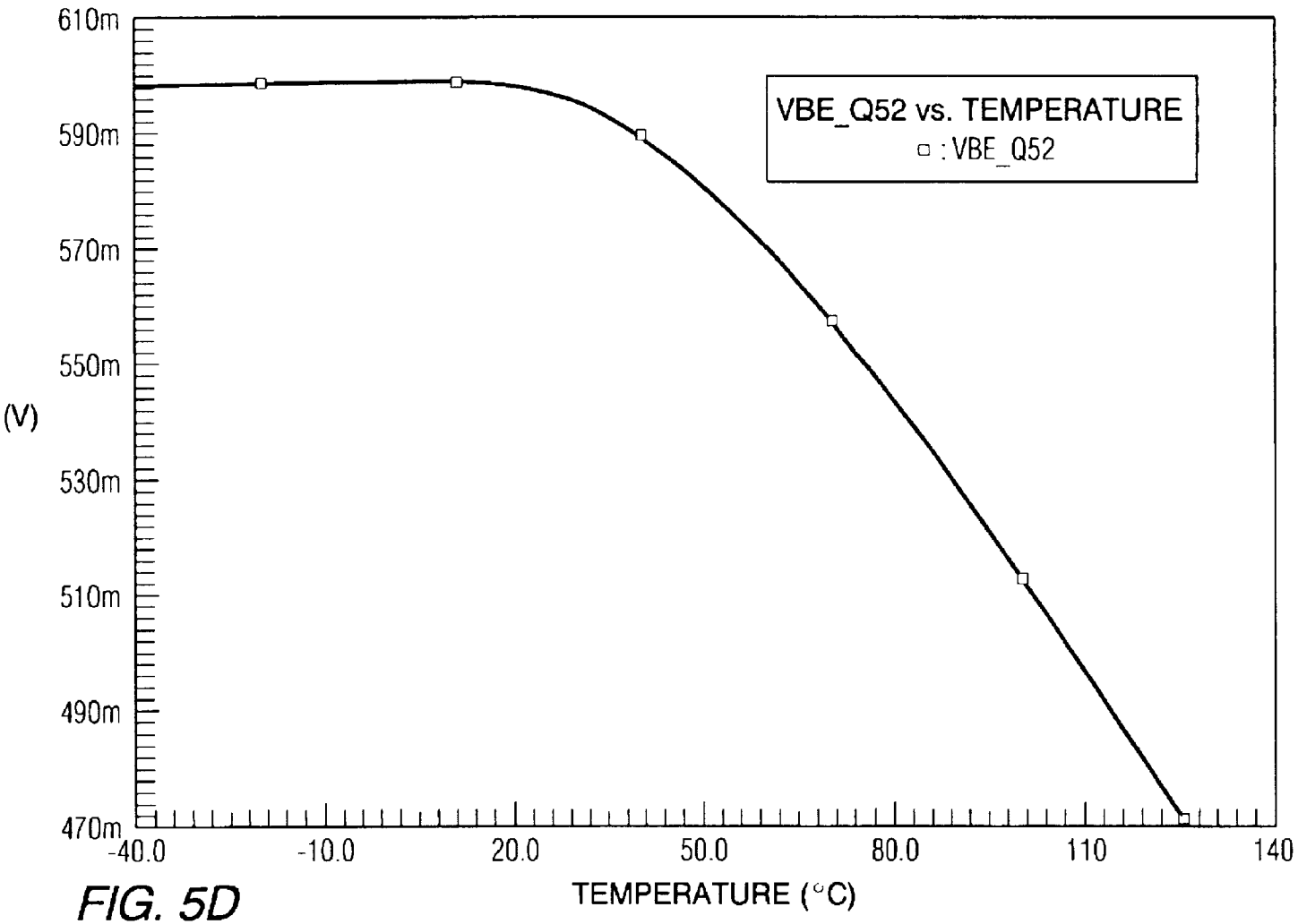
FIG. 5D is a graphical plot showing the variation in base-emitter voltage $VBE_{Q52}$ of transistor Q52 of FIG. 5 with temperature.

The resistance of resistor R5A is set such that it becomes larger than the decreasing collector-emitter resistance of transistor Q51, so that its branch resistance stops its exponential decrease and becomes dependent on the resistance of resistor R5A. The effect of the resistance of the transistor Q51—resistor R5A branch being dominated by resistor R5A, and thus the transistor Q52 branch resistance becoming comparatively smaller, is such that the base-emitter voltage $VBE_{Q52}$ of transistor Q52 begins to decrease with temperature (as shown in FIG. 5D).

Figure 5E:
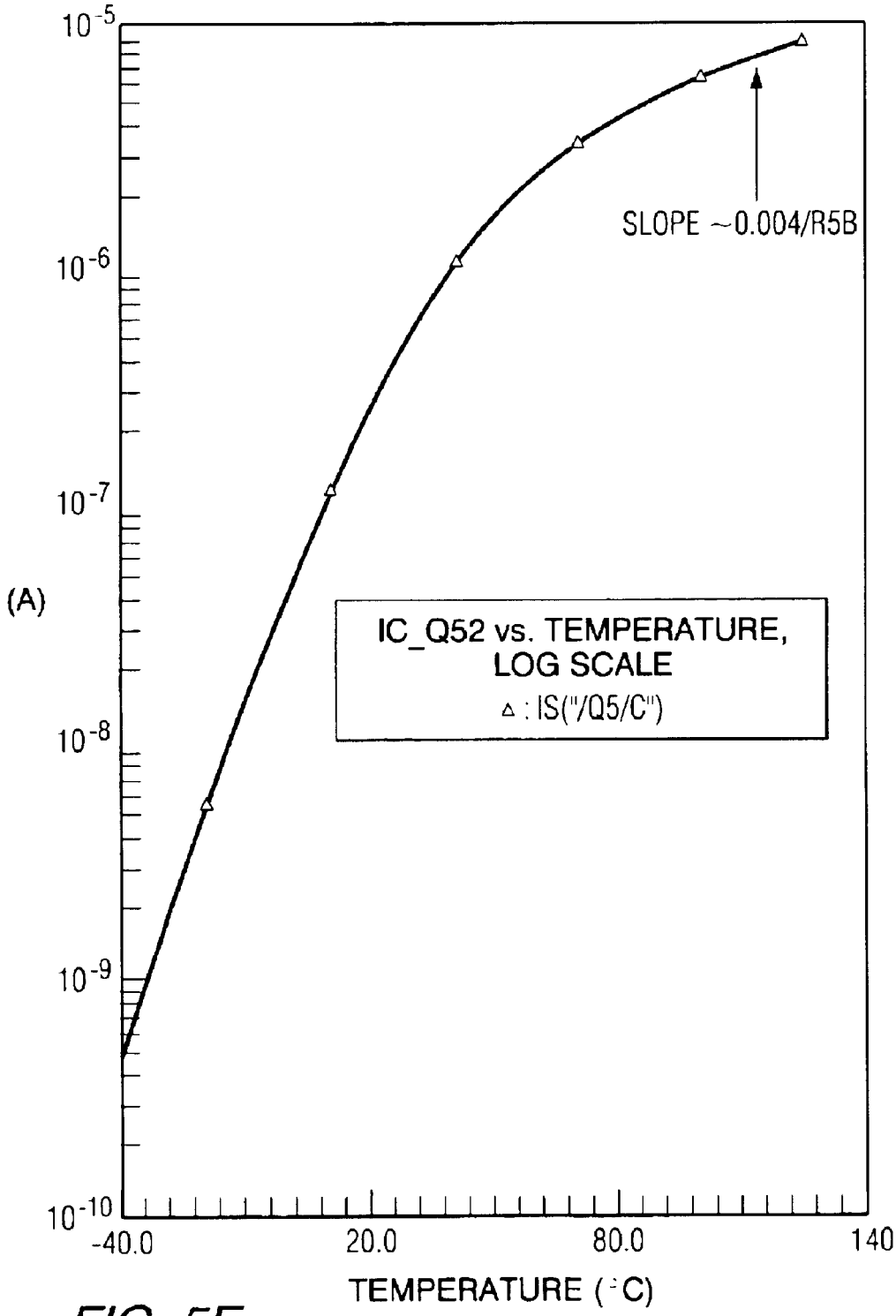
FIG. 5E is a graphical plot showing the variation in collector current $IC_{Q52}$ of transistor Q52 of FIG. 5 with temperature.
Figure 5F:
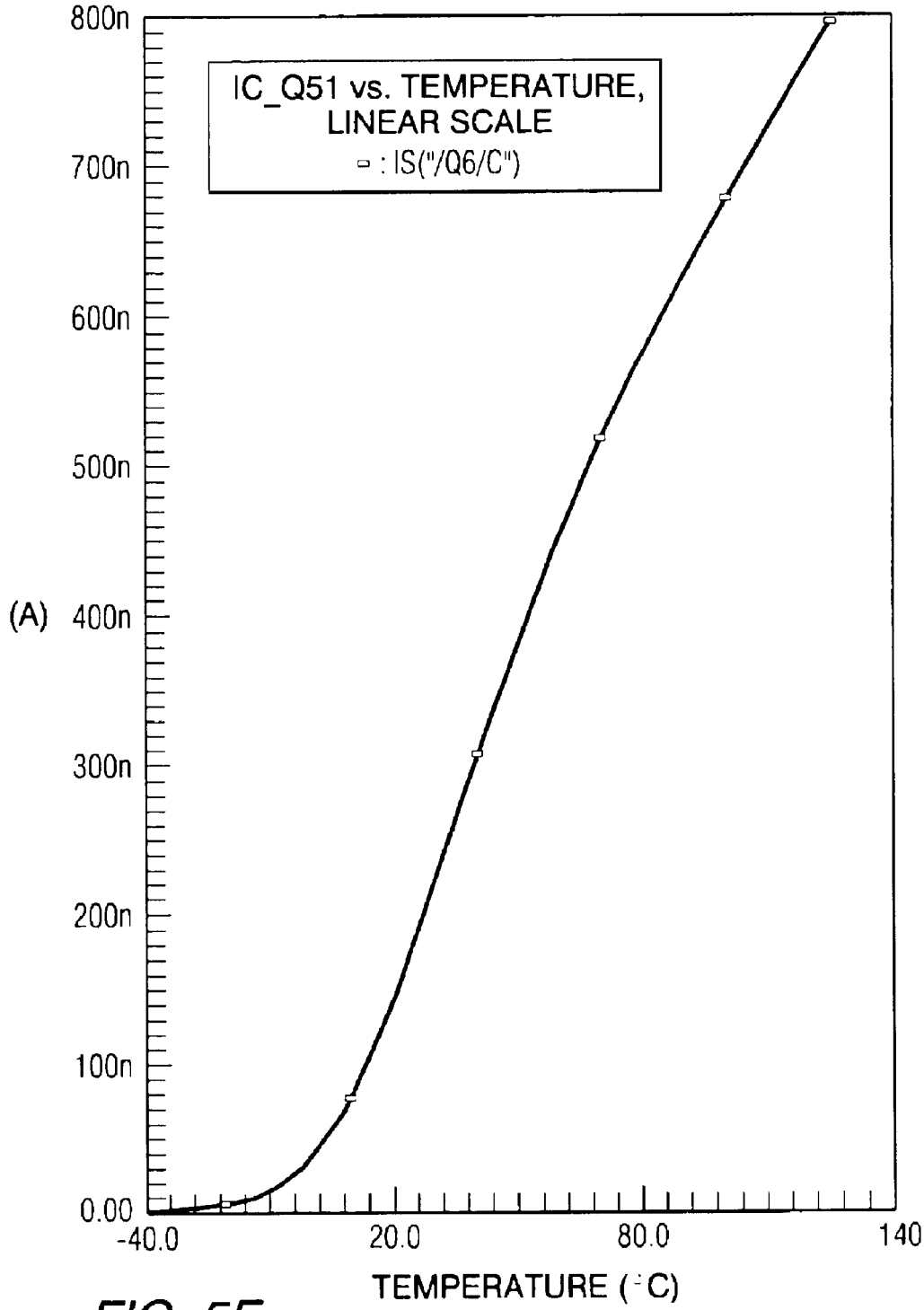
FIG. 5F is a graphical plot showing the variation in collector current $IC_{Q51}$ of transistor Q51 of FIG. 5 with temperature.

With the decrease in the base-emitter voltage of transistor Q52, the RCE of transistor Q52 begins to increase again, until the effects of increasing temperature become more dominant again and cause the resistance to decrease. At temperatures above this point, the voltage across resistor R5B increases in proportion to the temperature coefficient of 2VBEs, which is approximately (−1)(2)(−2 mV/° C.)=±4 mV/° C., on a first-order basis (as shown in FIG. 5E; FIG. 5F shows the variation in collector current $I_{Q51}$ of transistor Q51 with temperature).

Figure 3:
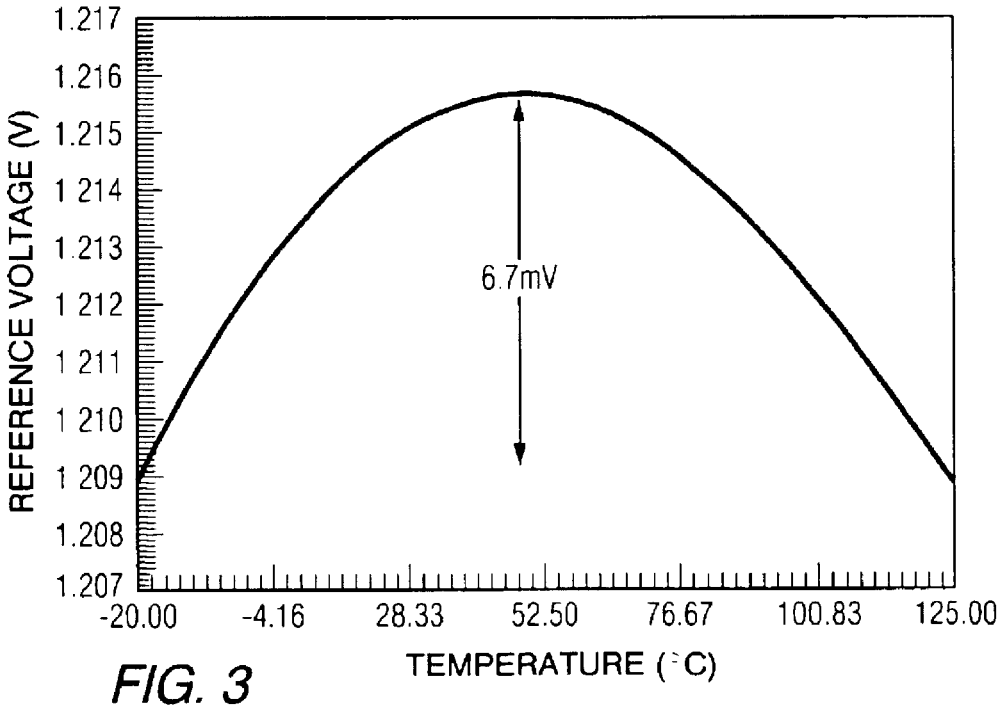
FIG. 3 PRIOR ART
FIG. 3 shows the variation with temperature of the output voltage of the bandgap voltage reference circuit of FIG. 2.
Figure 9:
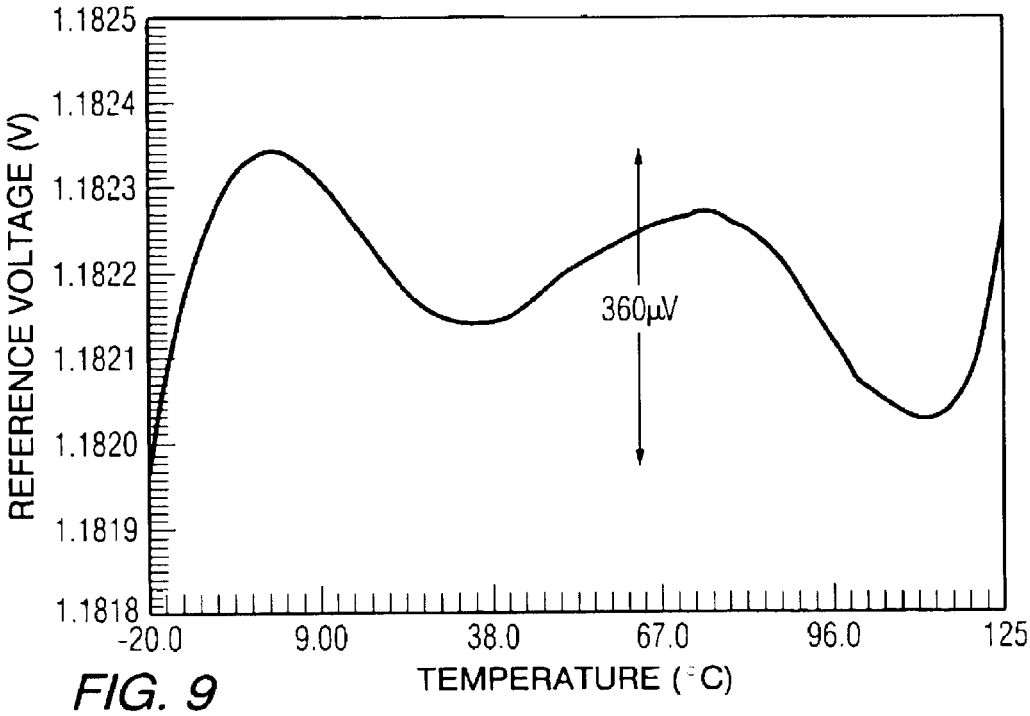
FIG. 9 shows a high-order temperature compensated bandgap voltage reference vs. temperature characteristic produced by the voltage reference of FIG. 6.

The characteristics of the output current of the non-linear current generator improve the temperature performance of the bandgap voltage reference. With a first-order bandgap voltage reference curve shifted toward colder temperatures (as shown in FIG. 3), the added positive temperature coefficient of the non-linear current generator initially causes the decreasing output voltage to increase (as shown in FIG. 9). Then, as the slope of the output current vs. temperature of the non-linear current generator begins to decrease, the output voltage starts to decrease, until the contribution of the non-linear current causes the output voltage to increase again. When the resistor values are properly chosen, an optimized output voltage temperature characteristic can be seen.

Figure 4:
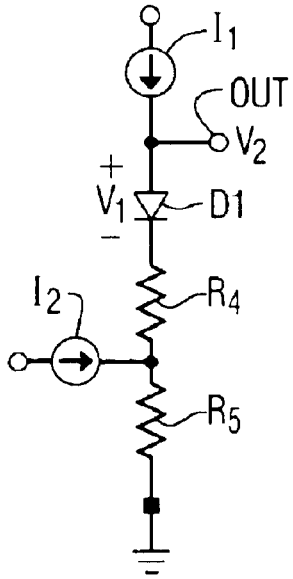
FIG. 4 PRIOR ART
FIG. 4 illustrates a higher order compensating modification of the current-based voltage reference of FIG. 1, which employs an additional current component having a non-linear temperature coefficient.
Figure 6:
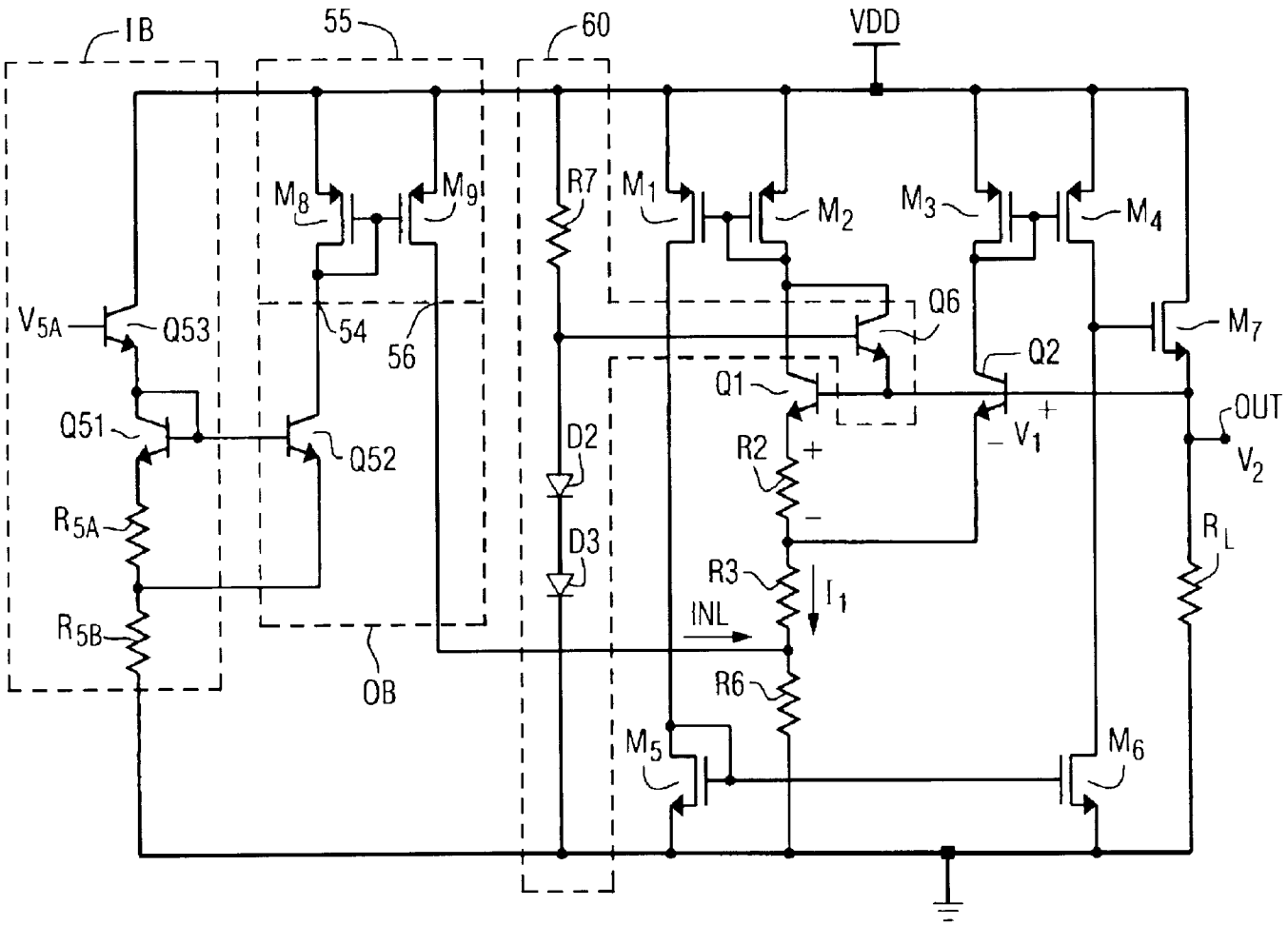
FIG. 6 schematically illustrates the manner in which the current mirror-based voltage reference circuit of FIG. 2 may be modified to incorporate the voltage-controlled, non-linear current generator of FIG. 5.

FIG. 6 schematically illustrates the manner in which the current mirror-based voltage reference circuit of FIG. 2 may be modified to incorporate the voltage-controlled, non-linear current generator of FIG. 5. Components and connections of FIG. 6 that are identical to those shown in FIGS. 2 and 5 will not be redescribed. The augmented voltage reference circuit FIG. 6 differs from that of FIG. 2 by the addition of a resistor R6, coupled in series with resistor R3 and referenced to ground, and coupling the non-linear current $I_{NL}$ to the node between resistors R3 and R6. Resistor R6 corresponds to the resistor R5 in the higher order compensation diagram of FIG. 4, described above. In addition, the circuit of FIG. 6 includes a start-up circuit 60 comprising a further bipolar (NPN) transistor Q6 having its collector-emitter path coupled across the collector and base of transistor Q1, and its base coupled to a voltage divider circuit comprised of resistor R7 and series-connected diodes D2 and D3 between VDD and GND.

Figure 7:
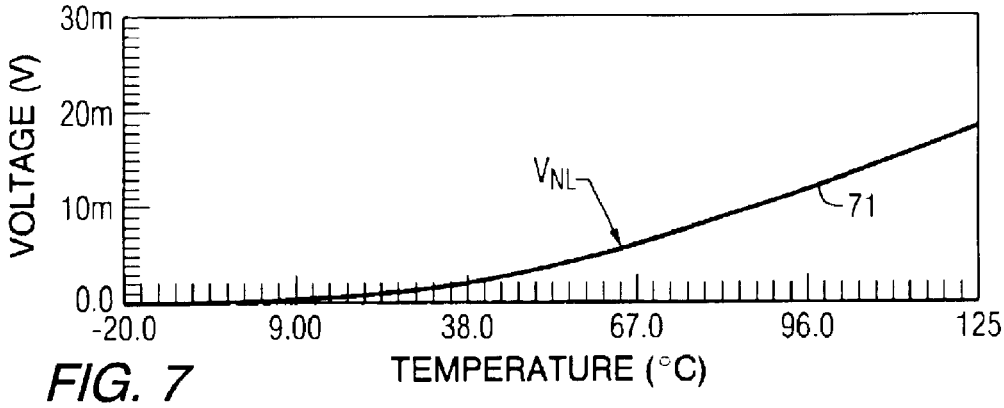
FIG. 7 shows a non-linear variation with temperature of a voltage $V_{NL}$ across the ground-coupled, current-summing resistor of the voltage reference of FIG. 6 due to the current supplied from the non-linear current generator of FIG. 5.

FIG. 7 shows a non-linear variation 71 with temperature of the voltage $V_{NL}$ across the ground-coupled resistor R6 as a result of the non-linear current component $I_{NL}$ injected through resistor R6 from the current mirror 55 of the non-linear current generator. It can be seen that the non-linear portion of voltage curve 71, which has a total variation on the order of only 20 millivolts over the entire temperature range, lies essentially at low temperatures and becomes relatively linear in the upper region of the temperature range (on the order of 75° C. and above)

Figure 8:
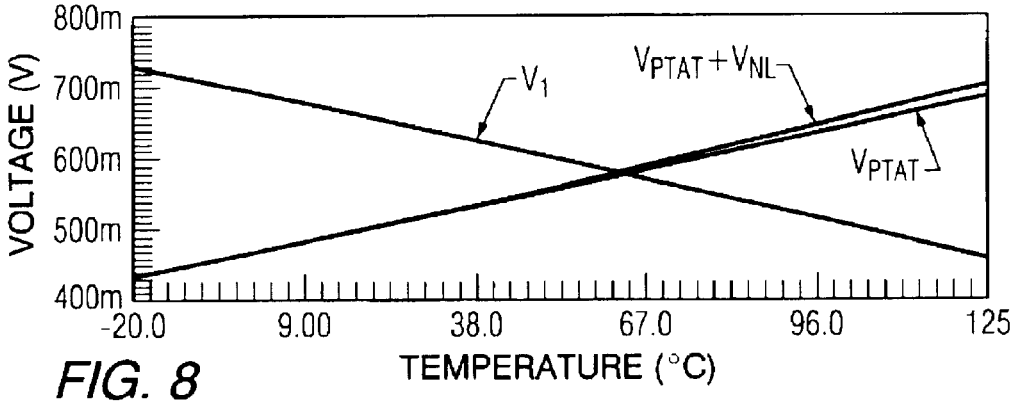
FIG. 8 shows the non-linear voltage variation $V_{NL}$ of FIG. 7 riding on a linear $V_{PTAT}$ voltage.

FIG. 8 shows the non-linear voltage variation $V_{NL}$ of FIG. 7 'riding on' extending slightly upwardly from a linear $V_{PTAT}$ voltage developed across resistors R3 and R6 due to the current I1 flowing therethrough. Also shown in FIG. 8 is the CTAT voltage V1, corresponding to the base-emitter of transistor Q2, between output terminal OUT and the series-connected resistor pair R3–R6. Summing the voltage profiles $V1+V_{PTAT}+V_{NL}$ of FIG. 8 produces the high-order temperature compensated bandgap voltage reference vs. temperature characteristic of FIG. 9, which corresponds to that of the output voltage V2 provided at the output terminal OUT. As shown therein, over an operational temperature range of −20° C. to +125° C., the output voltage V2 is confined within a very narrow 360 microvolt range, which corresponds to a temperature coefficient of only 2.10 ppm/° C.

Figure 10:
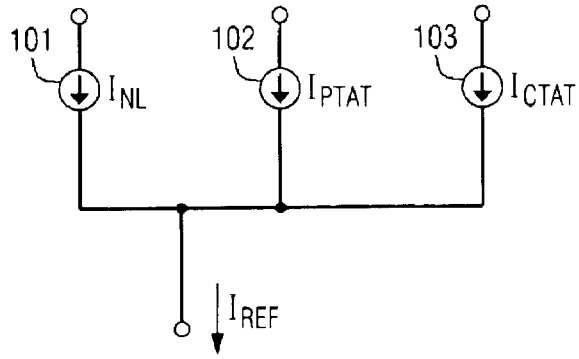
FIG. 10 shows a combination of the non-linear current generator of the invention with PTAT and CTAT current sources to produce high-order compensation reference current $I_{REF}$.
Figure 11:
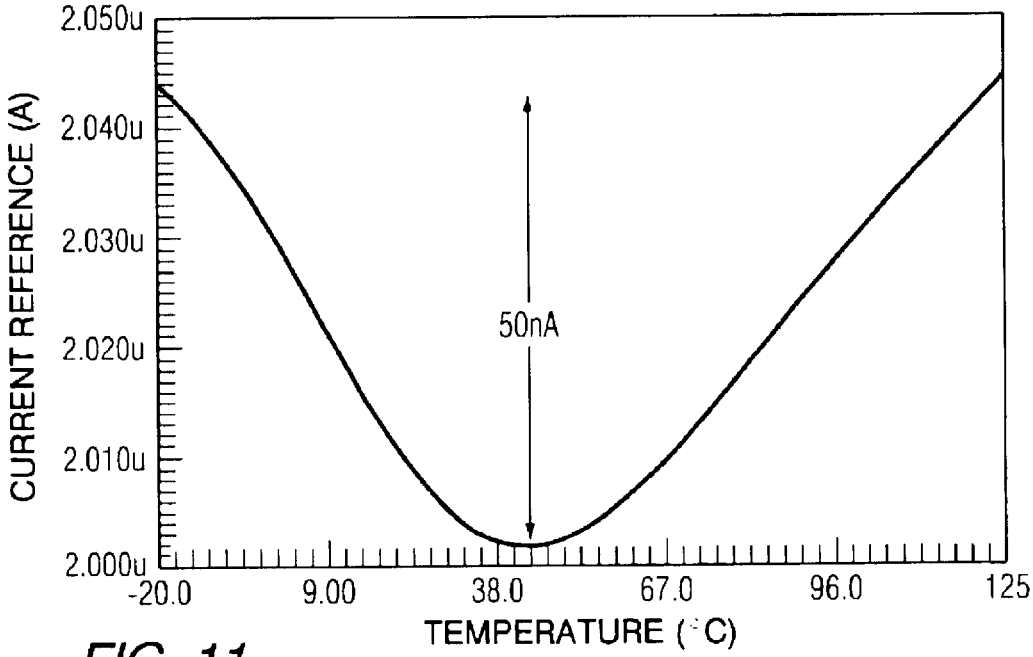
FIG. 11 shows the variation of reference current $I_{REF}$ with temperature curve of the composite circuit of FIG. 10.

In addition to employing the non-linear current generator of the present invention as a source of high-order compensation current, as in the augmented voltage reference of FIG. 6, the non-linear current generator of FIG. 5, may be combined with other temperature controlled current sources, such as conventional complementary, temperature dependent (e.g. PTAT and CTAT) current sources, as diagrammatically illustrated in FIG. 10, to provide another embodiment of a high-order, temperature-compensated current reference $I_{REF}$. In the embodiment of FIG. 10, the non-linear current source of FIG. 5, shown at 101, is summed with currents produced by a PTAT current source 102 and a CTAT current source 103, to produce a high-order, temperature-compensated output current reference $I_{REF}$, which exhibits the output current vs. temperature curve of FIG. 11. As shown therein, the range of variation of the resulting current reference $I_{REF}$ is very narrow (only 50 nanoamps over a temperature range of −20° C. to 125° C., or only +/−1.24%).

While I have shown and described several embodiments in accordance with the present invention, it is to be understood that the same is not limited thereto but is susceptible to numerous changes and modifications as known to a person skilled in the art. I therefore do not wish to be limited to the details shown and described herein, but intend to cover all such changes and modifications as are obvious to one of ordinary skill in the art.

What is claimed:

1. A current generator comprising:

an input transistor, having a controlled current flow path coupled through a PN junction device to a resistor circuit between first and second power supply terminals, and having a control electrode coupled to receive a control voltage; and an output transistor having an output current flow path therethrough coupled between an output terminal and a common connection of said resistor circuit, and a control electrode thereof coupled to said PN junction device; and wherein said control voltage has a value such that, in a low temperature region of operational temperature range, said output current of said output transistor has a non-discontinuous, non-linear temperature coefficient, and above said low temperature region of said operational temperature range, said output current has a generally linear temperature coefficient.

2. A current generator comprising an input transistor, having a controlled current flow path coupled through a PN junction device to a resistor circuit between first and second power supply terminals, and having a control electrode coupled to receive a control voltage; and an output transistor having an output current flow path therethrough coupled between an output terminal and a common connection of said resistor circuit, and a control electrode thereof coupled to said PN junction device; and wherein said control voltage has a value such that, in a low temperature region of operational temperature range, said output current of said output transistor has a non-linear temperature coefficient, and above said low temperature region of said operational temperature range, said output current has a generally linear temperature coefficient, and wherein said control voltage has a value such that, in said low temperature region of operational temperature range, said PN junction device operates just below a non-linear transition region of its non-linear characteristic, so that said output current produced by said output transistor has said non-linear temperature coefficient and, in response to said operational temperature reaching a turn-on temperature of said transistors, variation in current through said output transistor changes from non-linear to generally linear.

3. The current generator according to claim 1, wherein said resistor circuit comprises series-connected resistors.

4. The current generator according to claim 1, further including a current mirror having an input coupled to said current flow path of said output transistor, and an output coupled to said output terminal.

5. A current generator comprising:

an input transistor, having a controlled current flow path coupled through a PN junction device to a resistor circuit between first and second power supply terminals, and having a control electrode coupled to receive a control voltage; and an output transistor having an output current flow path therethrough coupled between an output terminal and a common connection of said resistor circuit, and a control electrode thereof coupled to said PN junction device; and wherein said control voltage has a value such that, in a low temperature region of operational temperature range, said output current of said output transistor has a non-linear temperature coefficient, and above said low temperature region of said operational temperature range, said output current has a generally linear temperature coefficient, and wherein said PN junction device comprises a diode-connected transistor, and said turn-on temperature of said transistors corresponds to a forward base-emitter voltage turn-on temperature of said transistors.

6. A current generator comprising:

an input transistor, having a controlled current flow path coupled through a PN junction device to a resistor circuit between first and second power supply terminals, and having a control electrode coupled to receive a control voltage; and an output transistor or having an output current flow path therethrough coupled between an output terminal and a common connection of said resistor circuit, and a control electrode thereof coupled to said PN junction device; and wherein said control voltage has a value such that, in a low temperature region of operational temperature range, said output current of said output transistor has a non-linear temperature coefficient, and above said low temperature region of said operational temperature range, said output current has a generally linear temperature coefficient, and wherein said output current is coupled as a high-order compensating current input to a Brokaw temperature-compensated bandgap voltage reference circuit.

7. A current generator comprising:

an input transistor, having a controlled current flow path coupled through a PN junction device to a resistor circuit between first and second power supply terminals, and having a control electrode coupled to receive a control voltage; and an output transistor having an output current flow path therethrough coupled between an output terminal and a common connection of said resistor circuit, and a control electrode thereof coupled to said PN junction device; and wherein said control voltage has a value such that, in a low temperature region of operational temperature range, said output current of said output transistor has a non-linear temperature coefficient, and above said low temperature region of said operational temperature range, said output current has a generally linear temperature coefficient, and wherein said output current is coupled to the output of a PTAT current source that generates a PTAT current having a proportional-to-absolute temperature (PTAT) characteristic, and to the output of a CTAT current source generating a CTAT current having a complementary-to-absolute temperature characteristic (CTAT), to produce a composite current.

8. A curvature-corrected voltage reference circuit comprising:

a first current source that supplies, to a resistor circuit, a first current having a proportional-to-absolute-temperature (PTAT) characteristic;

a voltage source coupled with said first current source and said resistor circuit, and being operative to generate a voltage having a complementary-to-absolute temperature characteristic (CTAT); and a second current source, coupled to said resistor circuit and being operative to supply thereto a second current, such that, in a prescribed low temperature region of operational temperature range, said second current has a non-linear temperature coefficient, and above said low temperature region of said operational temperature range, said second current has a generally linear temperature coefficient; and wherein a curvature-corrected voltage is derived from voltage drops across said resistor in accordance with said first and second currents supplied thereto, in combination with a CTAT voltage produced by said voltage source; and wherein said second current source comprises:

an input transistor, having a controlled current flow path coupled through a PN junction device to said resistor circuit, between first and second power supply terminals, and having a control electrode coupled to receive a control voltage; and an output transistor having a current flow path coupled between an output terminal and said resistor circuit, and a control electrode thereof coupled to said PN junction device; and wherein said control voltage has a value such that, in a low temperature region of operational temperature range, said PN junction device operates just below a non-linear transition region of its non-linear characteristic, so that an output current produced by said output transistor as said second current has a non-linear temperature coefficient and, in response to said operational temperature reaching a turn-on temperature of said transistors, a variation in said second current output from said output transistor changes from non-linear to generally linear.

9. The curvature-corrected voltage reference circuit according to claim 8, wherein said second current source further includes a current mirror having an input coupled to said current flow path of said output transistor, and an output coupled to said output terminal.

10. The curvature-corrected voltage reference circuit according to claim 9, wherein said PN junction device comprises a diode-connected transistor, and said turn-on temperature of said transistors corresponds to a forward base-emitter voltage turn-on temperature of said transistors.

11. A curvature-corrected voltage reference circuit comprising:

a first current source that supplies, to a resistor circuit, a first current having a proportional-to-absolute-temperature (PTAT) characteristic;

a voltage source coupled with said first current source and said resistor circuit, and being operative to generate a voltage having a complementary-to-absolute temperature characteristic (CTAT); and a second current source, coupled to said resistor circuit and being operative to supply thereto a second current, such that, in a prescribed low temperature region of operational temperature range, said second current has a non-linear temperature coefficient, and above said low temperature region of said operational temperature range, said second current has a generally linear temperature coefficient; and wherein a curvature-corrected voltage is derived from voltage drops across said resistor in accordance with said first and second currents supplied thereto, in combination with a CTAT voltage produced by said voltage source; and wherein said resistor circuit comprises plural resistors coupled in series with said firs current source and said voltage source between first and second voltage supply terminals, and wherein said second current source is operative to supply said second current to a first of skid plural resistors that is coupled to said second voltage supply terminal, wherein said voltage source comprises a base-emitter junction of a transistor, said base-emitter junction being coupled to a second of said plural resistors, so that a first PTAT voltage is produced across said second resistor in accordance with the product of said first current and a value of said second resistor, and a second composite, non-linear voltage is produced across said first resistor in accordance with, the product of a value of said first resistor and a composite current containing said first and second currents, said curvature-corrected voltage being derived in accordance with the sum of a base-emitter voltage of said transistor, said PTAT voltage and said second composite, non-linear voltage.

12. A current generator comprising:

a first current source that generates a first current having a proportional-to-absolute-temperature (PTAT) characteristic;

a second current source that generates a second current having a complementary-to-absolute temperature characteristic (CTAT); and a third current source that generates a third current whose temperature coefficient exhibits a prescribed non-linear-to-linear curvature; and wherein said first, second and third currents are combined to produce a composite output current, and wherein p1 said third current source is operative to generate said third current, such that, in a prescribed low temperature region of operational temperature range, said third current has a non-linear temperature coefficient, and above said low temperature region of said operational temperature range, said third current has a generally linear temperature coefficient.

13. The current generator according to claim 12, wherein said third current source includes:

an input transistor, having a controlled current flow path coupled through a PN junction device to a resistor circuit between first and second power supply terminals, and having a control electrode coupled to receive a control voltage; and an output transistor having a current flow path coupled between an output terminal and a common connection of said resistor circuit, and a control electrode thereof coupled to said PN junction device; and wherein said control voltage has a value such that, in a low temperature region of operational temperature range, said PN junction device operates just below a non-linear transition region of its non-linear characteristic, so that an output current produced by said output transistor as said third current has a non-linear temperature coefficient and, in response to said operational temperature reaching a turn-on temperature of said transistors, a variation in said third current changes from non-linear to generally linear.

14. The current generator according to claim 12, further including a current mirror having an input coupled to said current flow path of said output transistor, and an output coupled to said output terminal.

15. The current generator according to claim 12, wherein said PN junction device comprises a diode-connected transistor, and said turn-on temperature of said transistors corresponds to a base-emitter voltage turn-on temperature of said transistors.

* * * * *